US005542467A

United States Patent [19]

Carpentier

[11] Patent Number: 5,542,467

[45] Date of Patent: Aug. 6, 1996

[54] SAFETY ANNULAR HEAT EXCHANGER FOR INCOMPATIBLE FLUIDS

[75] Inventor: Pierre Carpentier, Soisy Sous Montmorency, France

[73] Assignee: Societe d'Etudes et de Constructions Aero-Navales, Gennevilliers, France

[21] Appl. No.: 212,570

[22] Filed: Mar. 11, 1994

[30] Foreign Application Priority Data

Jul. 6, 1993 [FR] France ..... 93 08254
Sep. 7, 1993 [EP] European Pat. Off. ..... 93402169

[51] Int. Cl.[6] ..... F28F 11/00; F28D 7/12

[52] U.S. Cl. ..... 165/70; 165/142; 165/154

[58] Field of Search ..... 165/142, 154, 165/155, 164, 70

[56] References Cited

U.S. PATENT DOCUMENTS

| | | | |
|---|---|---|---|
| 2,312,920 | 3/1943 | Litton | 165/185 X |
| 2,730,337 | 1/1956 | Roswell | 165/70 X |
| 3,120,868 | 2/1964 | Ballentine | 165/155 |
| 3,196,198 | 7/1965 | Rex | 165/154 X |
| 3,910,347 | 9/1975 | Woebcke | 165/142 |
| 4,059,882 | 11/1977 | Wunder | 165/154 X |
| 4,146,088 | 3/1979 | Pain | 165/141 |
| 4,479,535 | 10/1984 | Echigo et al. | 165/142 |
| 4,671,351 | 6/1987 | Rappe | 165/142 X |
| 5,219,535 | 6/1993 | Giacobbe et al. | 165/142 X |

FOREIGN PATENT DOCUMENTS

| | | | |
|---|---|---|---|
| 0267388 | 5/1988 | European Pat. Off. . | |
| 758810 | 1/1934 | France | 165/155 |
| 2107868 | 5/1972 | France . | |
| 130874 | 5/1902 | Germany | 165/154 |
| 3724459 | 2/1989 | Germany | 165/142 |
| 149791 | 7/1986 | Japan | 165/142 |
| 1590573 | 9/1990 | U.S.S.R. | 165/154 |
| 122563 | 1/1919 | United Kingdom | 165/142 |
| 570491 | 7/1945 | United Kingdom | 165/142 |
| 03318 | 2/1993 | WIPO . | |

*Primary Examiner*—Leonard R. Leo
*Attorney, Agent, or Firm*—Ralph H. Dougherty, P.A.

[57] ABSTRACT

An annular heat exchanger for incompatible fluids, such as reactive compounds, particularly for the aeronautics industry, in which a sealed bottle is fixed interior of a hollow body, with integral heat dissipators and novel fluid passageway orientation, whereby no leak can occur which would commingle the incompatible fluids.

5 Claims, 5 Drawing Sheets

SAFETY ANNULAR HEAT EXCHANGER FOR INCOMPATIBLE FLUIDS

FIELD OF THE INVENTION

The present invention relates to those heat exchangers for so called incompatible fluids. By the phrase "incompatible fluids", it should be understood such types of fluids that, when put together, are able to react in a dangerous manner, for example by self ignition, or still such types of fluids that, when mixed in certain conditions, are able to generate toxic compounds, or compounds having any other drawbacks.

BACKGROUND OF THE INVENTION

For having an effective heat exchange, the prior art has taught heat exchangers comprising a vat having an open side on which is fastened a header tank with hair pin shaped tubes secured thereto, those tubes extending within the vat.

In the above known embodiment, a first fluid circulates in the vat, which vat is possibly provided with baffles, while a second fluid circulates in the tubes, which second fluid is brought at one end of the tubes by a first collector box and collected from the second end of the tubes by a second header tank.

The known heat exchangers of the above mentioned type are satisfactory regarding the heat exchange capacity they have. But it may happen that leaks will occur, in particular at the feet of the tubes engaged in the header tanks closing the vat in which circulates the first fluid. Leaks may also be provided through perforations of the thin walled tubes having walls generally of about 6–8 tenths of a millimeter.

Actually, experiments have shown that fluids circulating in heat exchangers can carry waste products, and particularly metal chips. This is for example the case for lubricants of gear mechanisms. It thus happens sometimes that such metal chips will remain at a fixed place in the circuit of the heat exchanger while being submitted to a movement making that these metal chips produce a milling action which may cause a perforation of the wall of the circulation duct.

Present safety requirements in particular in the aeronautical industry, make that some components, such as are the heat exchangers, must be able to work during many hundreds of thousands of hours without any failure occurring because of these heat exchangers.

It has thus been found that the hereabove mentioned problems concerning the safety of use while ensuring a very good effectiveness with respect to the heat exchange lead to avoid to use heat exchangers of the tubular core type.

PURPOSE AND SUMMARY OF THE INVENTION

The invention provides a new heat exchanger which takes into account the hereabove mentioned drawbacks, and has such a construction that any communication between different fluids is effectively eliminated, possible leak being produced only toward the outside of the heat exchanger even if some of the walls of the circulation ducts that it comprises are submitted to an accidental abrasion.

According to the invention, the safety annular heat exchanger for incompatible fluids comprises a hollow body having one end closed by a bottom, a sealed bottle within this body, with this sealed bottle being rigidly and sealingly fixed to the hollow body, the bottle having at least one wall with two sides, heat dissipators being provided on each of these two sides, and this bottle forming a separation wall between a first and a second fluid respectively circulating on either side of the at least one wall of the bottle between an input channel and an output channel of the hollow body for one of the fluids and between an input duct and an output duct for an other one of the fluids.

According to other features of the invention, means are provided for avoiding that a troublesome heat exchange can be produced between the admission and delivery ducts for one fluid and the circulation ducts of this one fluid circulating according to a counter-flow direction around the admission ducts.

There is also provided means carrying into effect thick or composite walls for the heat exchange between the two fluids, the wall thickness of these walls being substantially greater than a corresponding wall thickness coming from a theoretical computation for ensuring an optimum heat exchange between two fluids circulating on either side of said walls. The bottle at least has thus a wall thickness between about one millimeter and a plurality of millimeters.

Further means are also provided according to the invention so that it is possible to make the walls ensuring the heat exchange between the two fluids while providing inner leak channels leading to outside of the heat exchanger.

Furthermore, the invention provides that the heat exchanger can have various shapes, in particular a circular shape, a paralleleliped shape or an arcuate shape, in order to adapt the best exchanger to any suitable machine, for example a jet engine in aeronautics or other similar machines.

Various other features of the invention will moreover be revealed from the following detail description.

BRIEF DESCRIPTION OF THE DRAWINGS

Embodiments of the invention are shown, as non limitative examples, in the accompanying drawings, wherein.

DESCRIPTION OF PREFERRED EMBODIMENTS

Figure 1:
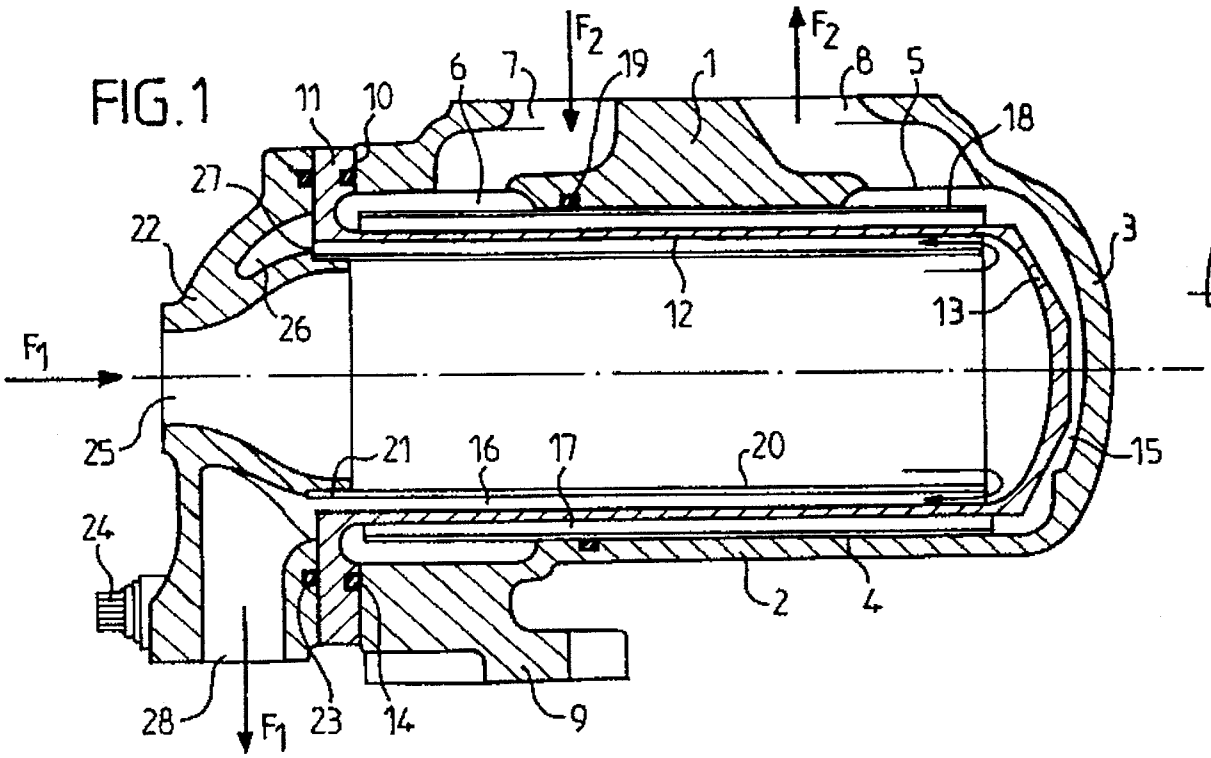
FIG. 1 is an elevation cross-section of an embodiment of the heat exchanger according to the invention.

The heat exchanger shown in the drawings comprises a body 1 made by moulding of a metal, for example aluminum or aluminum alloy, "Inconel", or still by machining of metal, either a light alloy, or a stainless steel, titanium or any other suitable metal for the use considered.

The body 1 forms an envelope 2 of a general cylinder shape, and which is closed at one end by a bottom 3 formed in one piece with the envelope 2.

The body 1 delimits an inner cylindrical wall 4 having ends provided with distributing and collecting recesses 5 and 6. The recess 6 has an annular shape while the recess 5 can extend only on a part of the periphery of the cylindrical wall 4.

The recesses 5 and 6 communicate with an input channel 7 and an output channel 8, respectively, designed to be connected to connection members leading to admission and discharge ducts (not shown).

In the embodiment shown in the drawings, the body 1 is provided with a fixation flange 9 designed to be mounted on any suitable support (not shown).

The body 1 could without departing from the scope of the invention, be an integral part of a carter of a motor or an other similar device.

The end of the body 1 which is opposed to the bottom 3 forms a bearing surface 10 for a flange 11 formed at one end of a sheath 12 closed by a bottom 13 so to make a sealed bottle. The sheath 12, the flange 11 and the bottom 13 are made as a single unit, preferably of a light alloy, manufactured by a machining method making that the wall of the sheath is relatively thick and always greater than the thickness which is computed for resisting to mechanical efforts, and the thickness of the wall of the sheath is at least about 1 to 3 mm.

The machining method for manufacturing the sheath 12, bottom 13 and flange 11 is chosen among the methods making that no creek is formed in the fluid separation wall that forms the whole unit in the shape of a bottle as above explained.

A machining of a solid part constitutes a suitable embodiment, as well as an embodiment comprising rolling of the sheath 12 and soldering of the bottom 13. An embossing or forging method can also be used.

A gasket 14, for example a o-ring is installed between the flange 11 and the bearing surface 10 of the body 1.

As shown in the drawings, the respective sizes of the sheath 12 and body 1 are chosen so that a space 15 will exist between the inner wall of the bottom 3 and the outer wall of the bottom 13, and also between the outer wall of the sheath 12 and the inner wall of the envelope 2 of the body 1.

Heat dissipators 16, formed for example by corrugated sheet, a plurality of fins or points, or other similar members, are protruding from the inner wall of the sheath 12 and, samely, heat dissipators 17 are protruding from the outer wall of the sheath 12 to extend on all the useful length thereof.

When the heat dissipators 16 and 17 are made by means of corrugated strips, well known in the heat exchanger art, they are connected to the sheath 12, for example by brazing. When the heat dissipators 16 and 17 are formed by fins, or points, they are manufactured by a machining method, for example by milling in a machining center providing a fluid separation wall partly made of the sheath 12 and the bottom 13. One will not depart from the scope of the invention by making the sheath 12 and the heat dissipators 16 and 17 by means of a casting method, a forging method, a spinning method, or by an other suitable method.

The heat dissipators 17 are surrounded by a sleeve 18 which can be made of metal or, possibly, synthetic material, which sleeve 18 is extending on all the useful length of said heat dissipators 17 while providing an annular free space with the inner wall of the flange 11 and with the inner wall of the bottom 13 of the body 1, respectively.

A sealing gasket 19 is preferably installed between the sleeve 18 and the cylinder wall 4 of the envelope 2, which sealing gasket 19 is possibly provided so to ensure only a relative tightness.

In a similar manner to what has been described in the above disclosure with respect to the heat dissipator 17, a second sleeve 20 is engaged within the heat dissipator 16.

The second sleeve 20 extends on all the useful length of the heat dissipator 16, and is supported in a neck 21 of a distributing cover 22 applied on the outer wall of the flange 11.

A sealing gasket 23 is installed between the distributing cover 22 and the flange 11. Fixing and holding means 24, for example screws or bolts, are provided for securing the distributing cover 22 on the flange 11 and for securing the flange 11 on the body 1.

The distributing cover 22 forms an inlet duct 25, arranged preferably coaxial to the sheath 12, and an annular manifold 26 communicating with the annular space 27 formed between the second sleeve 20 and the inner wall of the sheath 12.

The manifold 26 conducts to an output duct 28.

The above described heat exchanger is principally designed for enabling heat exchange between incompatible fluids, which means fluids that should in no case be put in contact together, as this can be the case between a fuel product, for example kerosene, and the lubrication oil of members of an engine or of a transmission when these two fluids are at very different temperatures, the lubrication oil having for example to be cooled-down by the fuel supplied to the engine.

The first fluid, for example the fuel, is supplied into the heat exchanger through the inlet duct 25 according to arrow $F_1$. The first fluid passes then in the space 27 formed between the second sleeve 20 and the outer surface of the sheath 12, which space 27 contains the heat dissipator 16.

This first fluid is then supplied to the annular manifold 26 and then to the outlet duct 28.

The second fluid, for example a lubricant oil, is supplied according to arrow $F_2$ to the inlet channel 7 that directs the second fluid to the annular recess 6 which forms a distributor that distributes and conducts this fluid within the sleeve 18, thereby flowing outside of the sheath 12 along the heat dissipators 16 and 17 carried by the sheath 12.

The space 15 separating the bottom 13 of the sheath 12 from the bottom 3 of the body 1 forms a manifold for the second fluid that is thus supplied to the recess 5 and then into the outlet channel 8.

The preceding disclosure shows that no passage whatsoever can exist between the circuit of the first fluid and that of the second fluid. If a leak would occur, the leak could only be produced between the flange 11 and the bearing surface 10 of the body 1, in case the gasket 14 is defective. But, in this case, the second fluid would be conducted to the outside without possibly rejoining a part of the circuit of the first fluid.

In a like manner, a leak in the circuit of the first fluid could only be produced between the outside of the flange 11 and the gasket 23 of the distributing cover 22. In this case, such a possible leak which would be caused by a defect in the gasket 23 could conduct the first fluid only to the outside without this first fluid being able in any case to come into the circuit of the second fluid.

In the above described example, the two fluids are circulating in a counter-flow direction. But one will not depart from the scope of the invention by using another way of circulation between the two fluids for means usual in the art. It is in particular possible to arrange partition walls at ends of some of the heat dissipators for establishing a zigzag flow of one and/or the other of the two fluids.

The sleeve 18 can be freely mounted relative to the envelope 2 and heat dissipators 16, or the sleeve 18 can be fixedly mounted with the envelope 2 while remaining free with respect to the heat dissipators 16, or still the sleeve 18 can be fixedly mounted with the heat dissipators 16 while being free with respect to the envelope 2. It is also possible not to use the sleeve 18 if the length of the distributing recess 6 is small relative to the length of the beat dissipators 16, which is illustrated for the heat dissipators shown at 16*a* in the embodiment to be described later on in reference with FIG. 5.

Samely, the second sleeve 20 is provided to be slidable with respect to the heat dissipators 16 or, if the sleeve 20 is fixedly mounted with the heat dissipators 16, the second sleeve 20 is provided to be movable with respect to the neck 21, thereby also avoiding stresses which could occur because of differential heat dilatations.

In the above disclosure, it has been mentioned that the sheath 12 has a thick wall, for example of about 1 to 3 mm in order to reduce, or even eliminate, any risks of communication between the circuit of the first fluid and that of the second fluids.

Figure 2:
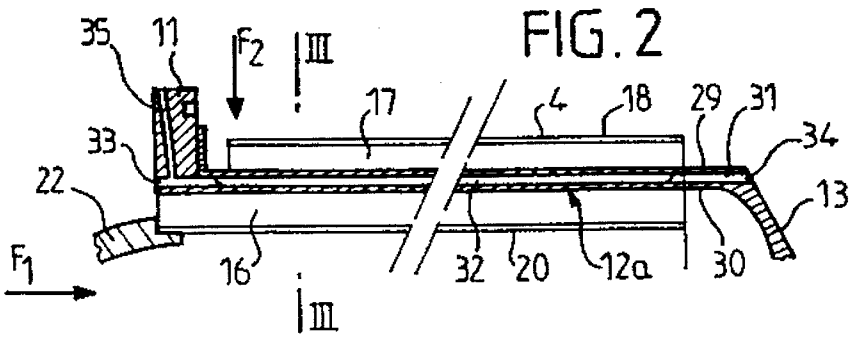
FIG. 2 is a partial cross-section illustrating an advantageous embodiment of one of the elements shown in FIG. 1.
Figure 3:
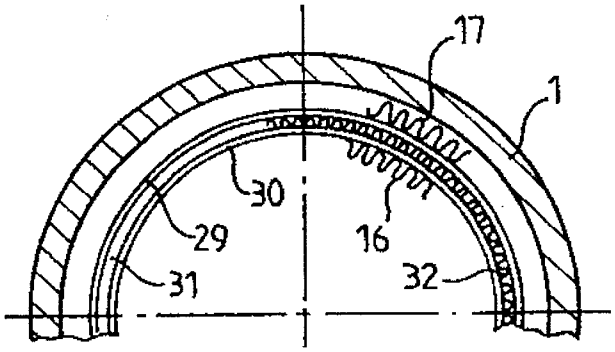
FIG. 3 is an enlarged half cross-section taken substantially along line III—III of FIG. 2.
Figure 4:
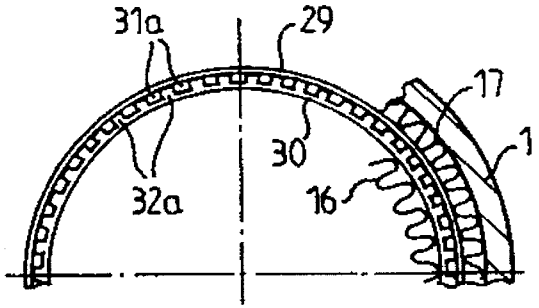
FIG. 4 is a half cross-section similar to FIG. 3 illustrating a variant of embodiment.

For still more eliminating a risk of accidental communication between the two circuits, FIGS. 2 to 4 illustrate means forming some developments of the invention for obtaining thick walls with good heat conductivity.

According to FIGS. 2 and 3, the sheath 12*a* of the bottle is formed by two tubular members 29, 30 providing therebetween an annular space 31. The tubular members 29, 30 are connected together on a greater part at least of their length by heat conducting members 32, for example strips, which are corrugated or have an other suitable shape, and which can be brazed or connected by any other suitable means to those tubular members 29, 30.

On an other hand, the tubular members 29, 30 are connected together at least at their ends by means of rings 33, 34, which are brazed or soldered in order to provide an absolute tightness.

Various means are known in the art for obtaining such an absolute tightness, and it is for example possible to use an electron beam soldering.

The annular space 31 advantageously communicates with a vent channel 35 provided in the flange 11. In this manner, in case one of the tubular members 29 or 30 has a leak, the first fluid $f_1$ or the second fluid $f_2$ will enter the annular space 31 and will be evacuated by the vent channel 35, which makes possible to immediately detect the anomaly.

FIG. 4 shows that the heat conducting members 32 can be made by fins 32*a* possibly formed by moulding together with one of the tubular members 29 or 30, so to divide the annular space 31 in longitudinal channels 31*a*.

Figure 5:
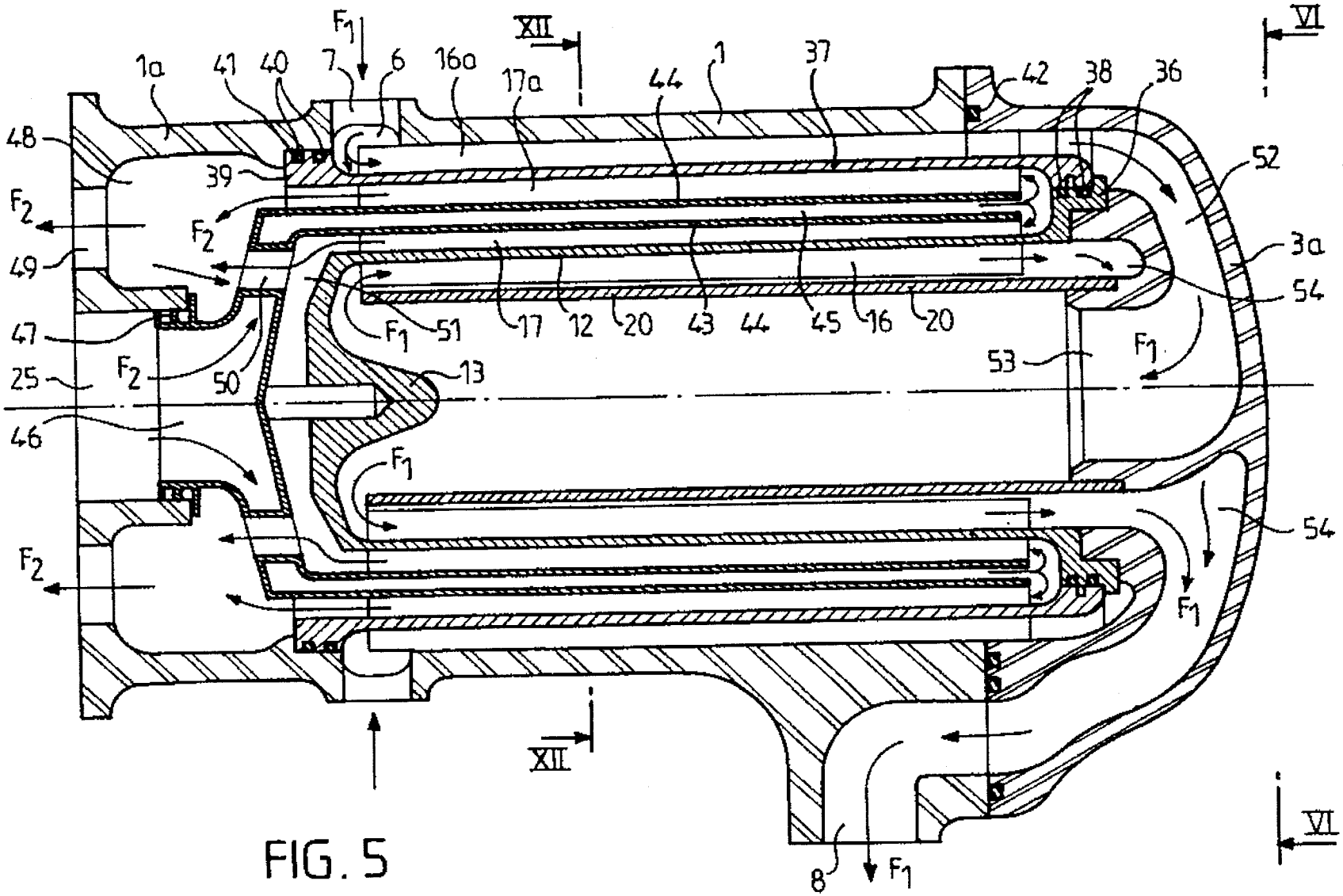
FIG. 5 is an elevation cross section similar to FIG. 1 illustrating a development of the invention.

FIG. 5 illustrates a development of the invention permitting to manufacture heat exchangers having a great output delivery.

In the embodiment of FIG. 5, the sheath 12 made as above described in relation with FIG. 1 comprises an open end provided with a ring 36 in which a socket 37 is centered, the socket 37 having thick walls, i.e. walls of a thickness similar to that of the sheath 12.

O-ring sealing gaskets 38 providing an absolute tightness are installed between the ring 36 and the socket 37, the free end of which socket 37 forms a flange 39 provided with o-ring sealing gaskets 40 which are supported on a bearing surface 41 of the end la of the body 1. The gaskets 40 provide also an absolute tightness.

In this embodiment, the body 1 is provided with a removable bottom 3*a* that is fixed, for example bolted, on the body 1, with an interposition of o-ring gaskets 42 providing an absolute tightness.

The sleeve 12 is provided, as in the embodiment of FIG. 1, with heat dissipators 16 and 17 and, in a similar manner, the socket 37 is provided with heat dissipators 16*a* and 17*a*, respectively, extending on both of its sides.

The beat dissipators 17 and 17*a* are supported on the inner wall 43 and outer wall 44 of a member forming an annular duct 45 extending from a distributing chamber 46 opening in the inlet duct 25 of the body 1.

The drawings show that sealing gaskets 47 are installed between the inner wall of the inlet duct 25 and the outer wall of the distributing chamber 46. The tightness which is thereby provided is not necessarily an absolute tightness.

The end 1*a* of the body 1 forms an outlet chamber 48 provided with an outlet nozzle 49.

At least one aperture 50 is provided between the chamber 46 and the annular duct 45 for communicating the chamber 48 with a chamber 51, the chamber 51 then communicating with the annular spaces separating the inner wall 43 and outer wall 44 of the duct 45 from the outside of the sheath 12 and the inside of the socket 37.

The above disclosure shows that the walls 43, 44 fulfill the function of either one of the sleeves 18 or 20 of the embodiment according to FIG. 1, in addition to functions to be described later.

The member that forms the chamber 46 and the walls 43, 44 of the annular duct 45 can be made of various materials, for example this member can be made of metal or of composite or plastic material, according to temperature of the fluids designed to bathe this member. Preferably, the above member is made of a material having a low heat conductivity, which can be obtained as described later-on with reference to FIG. 7.

The drawings show that the annular duct 45 is open at its end opposite the chamber 46 so that the fluid, which is supplied to the inlet duct 25 according to arrow $F_2$, is then supplied inside the annular duct 45 and goes out therefrom at its open end as shown by the arrows, and is conducted to the outlet chamber 48 in a counter-flow direction by following the heat dissipators 17 and 17*a*.

Because of the low conducting nature of the walls 43 and 44, the heat exchange is small between the fluid circulating between the walls 43 and 44 and the fluid circulating outside the walls 43 and 44.

To correspond to what has been discussed above relatively to the working of the heat exchanger of FIG. 1, it is assumed that the fluid circulating according to the arrow $F_2$ is the second fluid, for example a lubricant, having to be cooled down by a first fluid, for example a fuel having to be supplied to the combustion chamber of an engine.

In the embodiment of FIG. 5, the first fluid is supplied to the input channel 7 according to the arrow $F_1$. This first fluid is directed, as shown by the arrows so that the first fluid will circulate around the socket 37 along the heat dissipators 16*a* in a counter-flow direction to the first fluid circulating along the heat dissipators 17*a*.

The first fluid is therefore supplied to a passage 52 in the bottom 3*a* and leading to a median mouth 53 opening inside the bottle that is formed by the sheath 12, which means: inside the sleeve 20 surrounded by the heat dissipators 16 secured to the sheath 12.

Thus, the first fluid is supplied into the bottom 13 of the bottle and directed therefrom to the inside of the sleeve 20. This first fluid circulates then along the heat dissipators 16 on the outer wall of the sheath 12, which means that the first fluid then circulates in a counter-flow direction to the second fluid that circulates according to the arrow $F_2$ along the heat dissipators 17 which are carried by the outer wall of the sheath 12.

Figure 6:
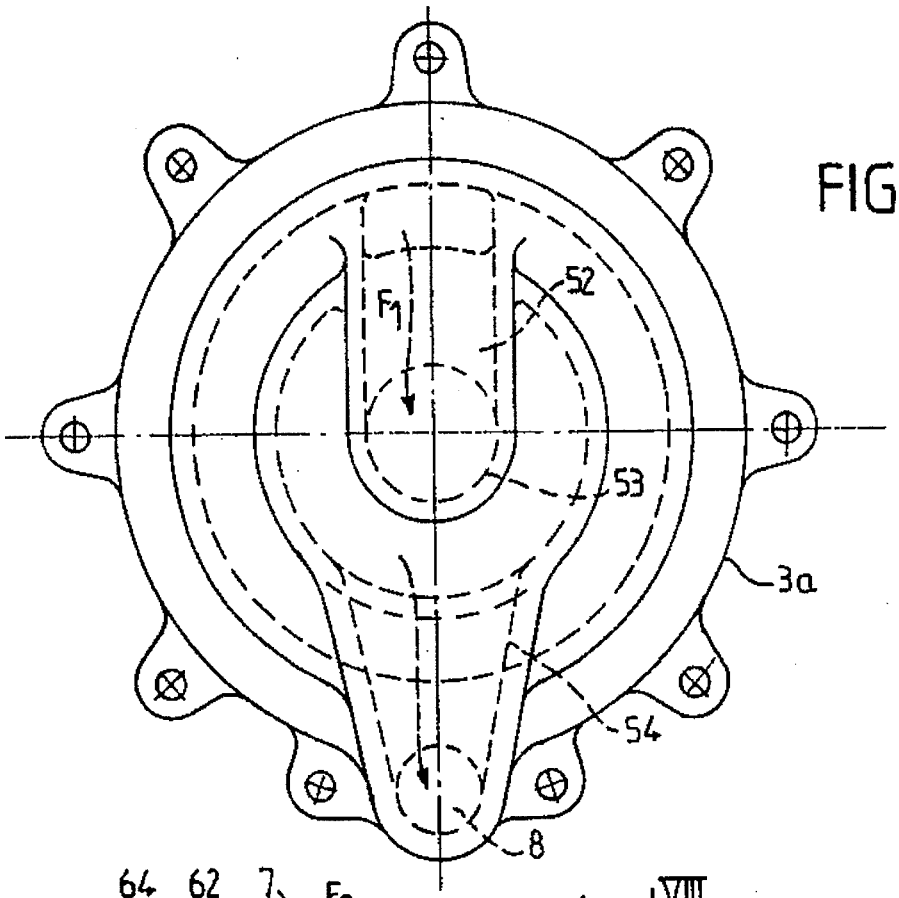
FIG. 6 is an elevation view according to line VI—VI of FIG. 5.

The first fluid is finally supplied into a manifold 54 (FIGS. 5 and 6) defined by the removable bottom 3*a*, and is thus directed to the outlet channel 8 of the body 1.

As this is clear from the above disclosure, the first fluid always circulates outside of the socket 37 and inside of the sheath 12 so that an absolute tightness is only necessary between these two parts, i.e. at the annular gaskets 38 and also between the socket 37 and the bearing surface 41 of the end la of the body, which is provided by the o-ring sealing gaskets 40.

The second fluid, for its part, circulates only inside the socket 37 and outside the sheath 12. The risks of communication are thus extremely reduced since they are caused, either by a possible porosity of the socket 37 or of the sheath 12, or by an accidental perforation which could be caused by the presence of waste products as for example metal chips.

There is hereinafter described how, according to the invention, it is now possible to get rid of this risk.

In order to still increase tightness between the socket 37 and the sheath 12, it is advantageous to Join the ring 36 to one end to the socket 37 by a weld 55 (FIG. 9), the good carrying out of which weld can easily be checked by means known in the art.

Figure 9:
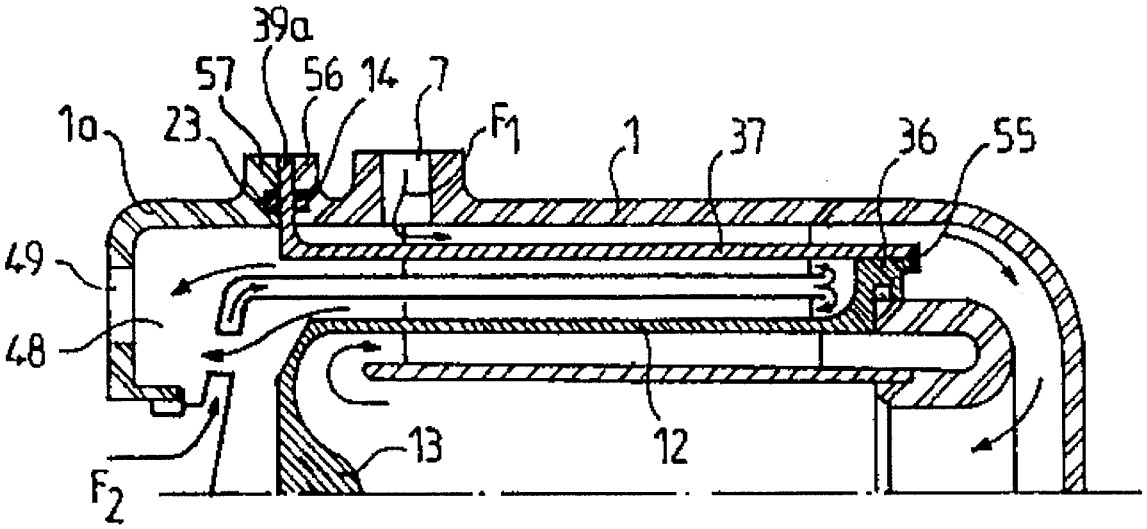
FIG. 9 is a partial cross-section illustrating the development of FIG. 5 in an embodiment similar to that of FIG. 1.

In this case, it is also advantageous as shown in FIG. 9, that the flange 39*a* of the socket 37 is tightened between complementary flanges 56 and 57, respectively of the body 1 and of the end 1*a* of the body 1. There is then used for maintaining the socket 37, the same means as that shown in FIG. 1 for maintaining the sheath 12.

Also as in FIG. 1, sealing gaskets 14 and 23 are provided and applied on the flange 39*a*. According to this embodiment, the only one possibility for the fluid $f_1$ to leak would be to leak between the flange 39*a* and the flange 56, which means outside of the body 1 of the heat exchanger and, samely, the only one possibility for the fluid $f_2$ to leak would be to leak between the flange 39*a* and the flange 57, which also means outside of the heat exchanger.

It has been mentioned in the above disclosure that it is advantageous to reduce as far as possible the heat exchange between the annular duct 45 and the heat dissipators 17 and 17*a*, respectively connected to the sheath 12 and to the inner wall of the socket 37.

Figure 7:
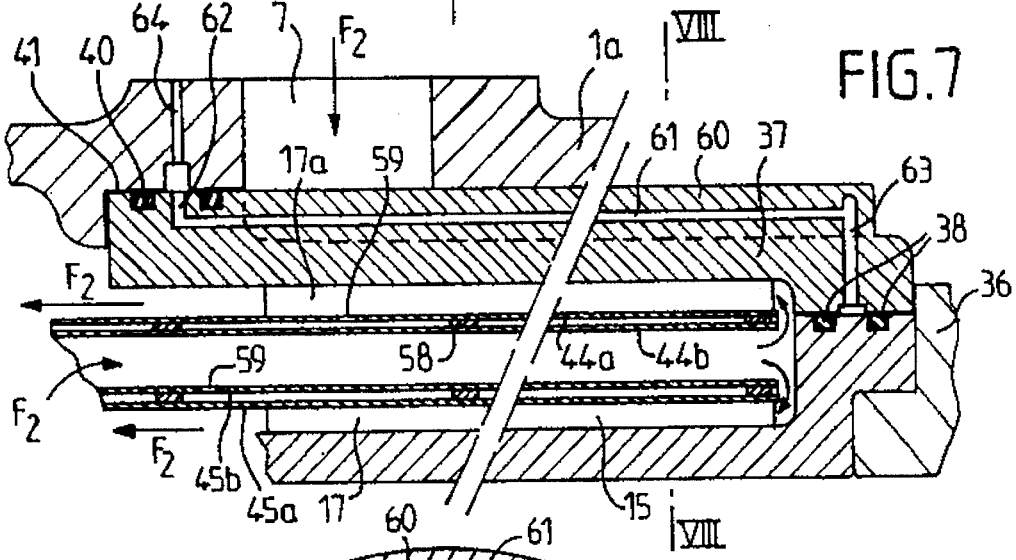
FIG. 7 is a partial elevation cross-section of the heat exchanger of FIG. 5 in an embodiment illustrating a development of the invention.
Figure 8:
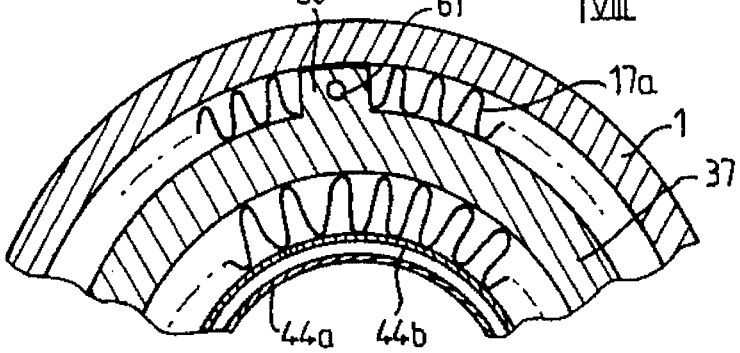
FIG. 8 is a cross-section taken along line VIII—VIII of FIG. 7.

FIGS. 7 and 8 illustrate an embodiment enabling to reduce such a heat exchange at a very small value. In this case, the member defining the annular walls 44 and 45 is made so that said walls are respectively formed by two concentrical tubes 44*a*, 44*b* and 45*a*, 45*b* which are spaced apart by means of spacers 58.

One at least of the tubes 44*a*, 44*b* and 45*a*, 45*b* has one or more apertures 59 so that some fluid $f_2$, that circulates inside the annular duct 45, or outside the annular duct 45, will fill the space separating the concentrical tubes 44*a*, 44*b* and 45*a*, 45*b*.

The apertures 59 are small so that circulation of the fluid contained between said concentrical tubes is reduced and even nil. In this manner, the fluid itself forms a heat screen that limits conduction.

FIGS. 7 and 8 also show an embodiment enabling an escape outside of the heat exchanger of one and/or the other fluid $f_1$, $f_2$ when the socket 37 is arranged as described by reference to FIG. 5, i.e. when the socket 37 comes to bear on the ring 36 of the sheath 12 through the gaskets 38 and bears, on an other hand, on the bearing surface 41 through the gaskets 40.

For this purpose, the socket 37 that is relatively thick for the same reason as the sheath 12 is moreover provided with a small longitudinal bar 60 having a channel 61 therein communicating with ducts 62, 63 opening respectively between the gaskets 40, on one hand, and between the gaskets 38, on the other hand.

The duct 62 is arranged to wards a discharge channel 64 in the end 1*a* of the body 1. In such a manner, a leak of the fluid $f_1$ which would occur in case of failure in one of the gaskets 38, would supply, the fluid through the ducts 63, 62 towards the channel 64. Samely, a leak of the fluid $f_2$ which would be caused by a deficiency in the other gasket 38 or in one of the gaskets 40 would supply this fluid towards the discharge channel 64.

Figure 10:
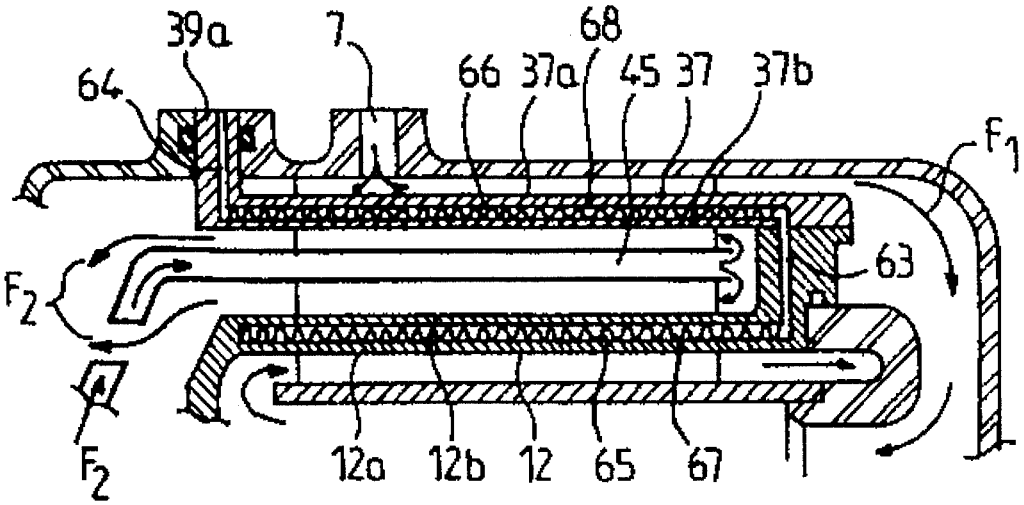
FIG. 10 is a partial elevation cross-section similar to FIG. 9 illustrating a further development of the invention.

FIG. 10 illustrates a development of the invention by which there is get rid of the risk of leaks through porosity or through a milling action possibly caused by waste products.

As shown in the drawings, the sheath 12, as well as the socket 37 are both made for having two walls 12*a*, 12*b* and 37*a*, 37*b*, respectively, defining annular chambers 65, 66 in which are arranged heat transmission members 67, 68. The heat transmission members 67, 68 can be formed by fins, coiled strips, bands that have been cut as heat disturbing elements, or still by other members providing a good heat transmission. The heat transmission members 67, 68 are preferably brazed to, or made integral with, one of the walls of the sheath 12 or socket 37.

The annular chambers 65, 66 are on an other hand connected together by the duct 63 as described above with reference to FIG. 7, and the duct 64 is provided in the flange 39*a* for communicating with the chamber 66 of the socket 37 or with the chamber 65 of the sheath 12 in the case of embodiment of FIG. 1 which does not comprise the socket 37.

The above disclosure shows that the working from a heat exchange point of view is not modified with respect to the embodiments above described with reference to FIGS. 1, 5 and 9 and that, besides, in case of damage to one of the walls 12*a*, 12*b* and 37*a*, 37*b*, respectively, either one of the fluids $f_1$ or $f_2$ is necessarily directed outside the heat exchangers thereby eliminating any risks of contact between the two fluids.

Figure 11:
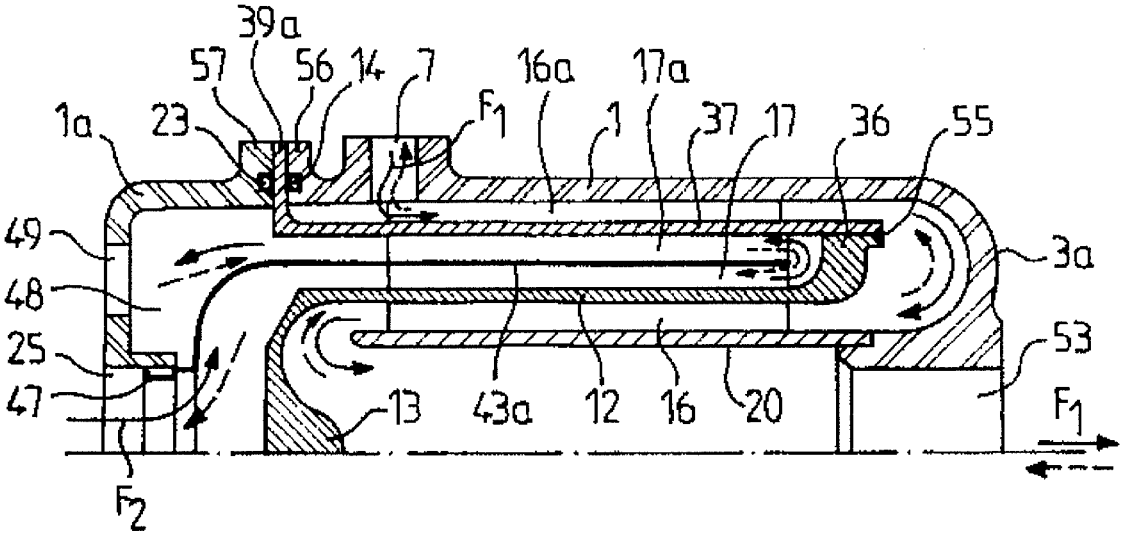
FIG. 11 is a partial cross-section similar to FIG. 9 illustrating a simplified embodiment.

FIG. 11 illustrates a simplified variant of the embodiments according to FIG. 5 or 9. In FIG. 11, the same reference numerals designate the same members as those described in the above embodiments.

The body 1 is made in order to be connected with a tightness, which can be a relative tightness, directly to one end of the sleeve 20 surrounded by the heat dissipators 16.

A single tube 43*a* is substituted to the tubes 43 and 44 of FIGS. 5 and 9, and this tube 43*a* is connected through the gasket 47, the tightness of which being possibly a relative tightness, to the mouth 25 of the end 1*a* of the body 1.

The tube 43*a* forms a separation wall between the heat dissipators 17 and 17*a* of the outer surface of the sheath 12 and inner surface of the socket 37, thereby defining a double circuit between said sheath 12 and sockets 37. One of the fluids can be caused to circulate from the mouth 25 by following the arrows $F_2$ shown in a full line to be supplied to the outlet duct 49, or this fluid can be caused to circulate from the outlet duct 49 by following the arrows illustrated in phantom, i.e. in a direction contrary to that of $F_2$. On an other hand, the other fluid can also circulate in one or in the other direction according to the arrows $F_1$. It is therefore possible to provide circulations both in a same direction, in a counter-flow direction or at a cross-flow direction.

Figure 12:
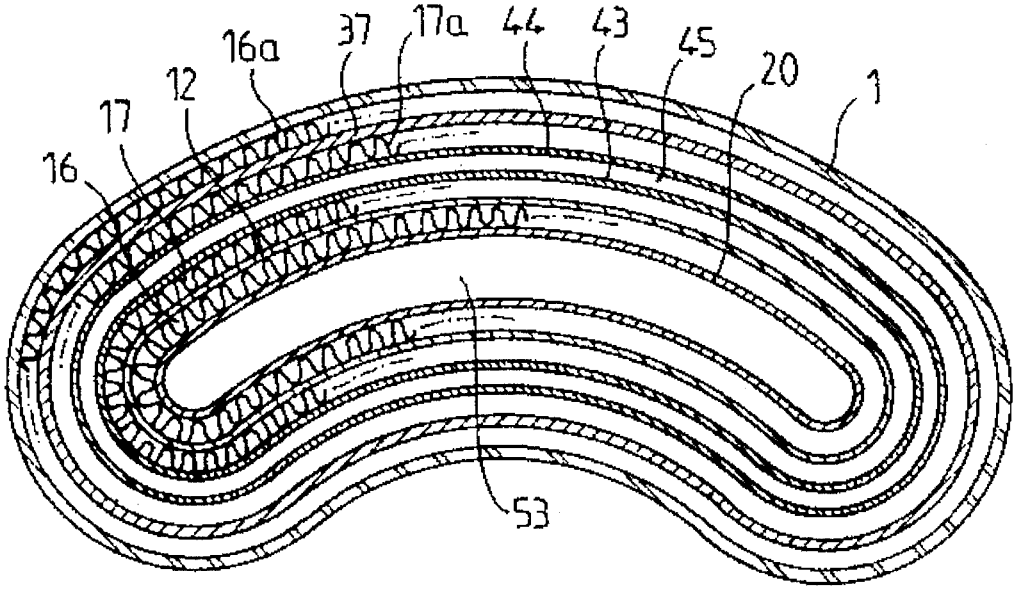
FIG. 12 is a cross-section taken along line XII—XII of FIG. 5 illustrating, in cross-section, a particular embodiment of the heat exchanger of FIGS. 1–11.

In the preceding disclosure, it has been mentioned that the envelope 1, the socket 37, the part delimiting the annular duct 45, the sheath 12, the sleeve 20, as well as the hereabove described members associated therewith, have an annular cross-section. FIG. 12 illustrates that it is possible to provide other sectional shape while carrying into effect all the above described features.

In this respect, FIG. 12 shows that the heat exchanger, in its embodiment shown in FIG. 5, can have an arcuate shape in order to be adaptable to a support member of a general cylinder shape, as this is the case for the walls of jet engines in aeronautics.

In FIG. 12, as in the preceding figures, the same reference numerals designate the same members as those detailed in the above disclosure.

It is obvious that other sectional shapes can be samely provided, the heat exchanger having possibly a rectangular cross-section which can be more or less flattened.

In the above disclosure, it has been explained that an absolute tightness should be obtained at various places of the circuits. For other parts of the circuits, for example between the ring 36 and the passage 52, or at the gasket 47, only a relative tightness should be provided. This relative tightness can be made by any suitable means known in the art, such as by gaskets, a tight fitting, interposition of an impregnation product, etc. . . .

What is claimed is:

1. An annular heat exchanger for preventing the mixing of incompatible fluids comprising:

a hollow body having one end closed by a bottom and the other end defining a bearing surface;

a sealed bottle positioned within said body having one end closed by a bottom and the other end comprising a flange for cooperating with said bearing surface, said sealed bottle having at least one annular wall, said wall having two sides and an annular fluid passage formed therein, said sealed bottle being rigidly and sealingly connected to said hollow body, while providing at least one leak circuit;

said leak circuit comprising a vent channel in said flange of said bottle for communicating with said annular fluid passage;

heat dissipators being provided on each of said two sides of said wall, said bottle separating a first and a second fluid respectively circulating on either side of said at least one wall of said bottle between an input channel and an output channel of said hollow body for one of said first and second fluids and between an input duct and an output duct for the other of said first and second fluids;

said dissipators being adapted to transmit heat between said first and second fluids through said at least one wall of said bottle; and said at least one wall of said bottle interiorly supporting said heat dissipators with said heat dissipators surrounding an inner sleeve for guiding one of said first and second fluids between said at least one wall and said inner sleeve.

2. The heat exchanger as set forth in claim 1 wherein said at least one wall of said bottle exteriorly supports said heat dissipators with said heat dissipators being surrounded by an outer sleeve for guiding one of said first and second fluids between said at least one wall and said outer sleeve.

3. The heat exchanger as set forth in claim 1 wherein said bottle is sealingly secured to said body at said flange.

4. The heat exchanger as set forth in claim 1 further comprising an end cover adjacent said flange of said bottle and a sealing gasket, said gasket providing a fluid-tight seal between said end cover and said flange.

5. The heat exchanger as set forth in claim 1 wherein said at least one wall of said bottle is integrally formed by an annular sheath having said one end closed by said bottom, said sheath and said bottom each made of a material that is heat conductive and having a thickness which is greater than at least about one to three millimeters.

* * * * *